US005209675A

United States Patent [19]

Korsunsky

[11] Patent Number: 5,209,675

[45] Date of Patent: May 11, 1993

[54] ELECTRONIC MODULE SOCKET WITH RESILIENT LATCH

[75] Inventor: Iosif Korsunsky, Harrisburg, Pa.

[73] Assignee: The Whitaker Corporation, Wilmington, Del.

[21] Appl. No.: 963,248

[22] Filed: Oct. 19, 1992

Related U.S. Application Data

[63] Continuation of Ser. No. 724,683, Jul. 2, 1991, abandoned.

[51] Int. Cl.[5] ..... H01R 13/62

[52] U.S. Cl. ..... 439/326

[58] Field of Search ..... 439/326–329, 439/59, 630–637

[56] References Cited

U.S. PATENT DOCUMENTS 4,850,891 7/1989 Walkup et al. ..... 439/326
4,986,765 1/1991 Korunsky et al. ..... 439/636
4,995,825 2/1991 Korunsky et al. ..... 439/328
5,004,429 4/1991 Yagi et al. ..... 439/326
5,013,257 5/1991 Korunsky et al. ..... 439/326

*Primary Examiner*—David L. Pirlot
*Attorney, Agent, or Firm*—Bruce J. Wolstoncroft

[57] ABSTRACT

A socket (20) for interconnecting an electronic module (2) to circuit board (14) includes an insulative housing (30) having a plurality of terminals (22) applying a moment to the module (2). A latch (100, 200, 300, 400, 500, 600) is positioned within a pocket (40) at each end of the insulative housing (30). The latch has two legs joined by a bight, the two legs being flexible as the module (2) is rotated into a slot (34) in the insulative housing (30) The latch includes an integral securing projection (152, 252, 352, 453, 552, 652) which cooperates with an opening (12) to maintain the module (2) in position relative to the housing (30).

28 Claims, 13 Drawing Sheets

ELECTRONIC MODULE SOCKET WITH RESILIENT LATCH

This application is a continuation of application Ser. No. 07/724,683 filed Jul. 2, 1991, now abandoned.

This application relates to an electrical connector or socket for establishing an interconnection with an electronic module and more specifically relates to a zero insertion or low insertion force socket having a resilient latch for securing an electronic module, such as a single in-line memory module, in position within the socket housing.

BACKGROUND OF THE INVENTION

Single in-line memory modules (SIMM) represent a high density, low profile single in-line package for electronic components such as dynamic random access memory integrated circuit components. A plurality of these components can be mounted in line on a circuit panel whose height is little more than the length of the components themselves. The circuit panels can in turn be mounted on a printed circuit board daughtercard which can then be mounted on a printed circuit board mothercard. The spacing between adjacent daughtercards would then need to be only slightly greater than the height of the individual circuit panels or single in-line memory modules.

One approach for mounting single in-line memory modules on a daughterboard would be to employ plug in leads adjacent to one edge of the circuit panel. These plug in leads can then be connected to conventional printed circuit board contacts such as miniature spring contacts.

Sockets or connectors containing a plurality of contacts can also be used to interconnect single in-line memory modules on a printed circuit board. For example, U.S. Pat. No. 4,737,120 discloses an electrical connector of the type suitable for use with a single in-line memory module in which a zero or low insertion force interconnection is established between the terminals and the pads on the circuit panel. The circuit panel is inserted at a angle and then cammed into position. The insulative housing on the connector provides a stop to hold the circuit panel in position. Other low insertion force connectors are disclosed in U.S. Pat. Nos. 4,136,917; 4,575,172; 4,826,446 and 4,832,617. Another socket of this type is shown in U.S. patent application Ser. No. 07/398,795 filed Aug. 24, 1989. The contact terminals in each of these patents is edge stamped. Sockets using terminals of this type are suitable for use on center line spacings on the order of 0.050 inches.

For conventional zero or low insertion force single in-line memory module sockets, integrally molded plastic latches are normally used to hold the modules in position. The configuration of the latch members provides the latch members with the resilient characteristics required in order to allow the latch members to cooperate with the daughter board. The latch members cooperate with securing members to maintain the daughter board in electrical engagement with the terminals of the connector. The securing members are generally molded posts which are separate from the latch members, and have molded tabs extending therefrom. The tabs cooperate with openings in the daughter card to maintain the daughter card in position.

However, several problems are associated with the configuration of the latch member described above.

The most common failure mode for plastic latches is caused by the lack of wear resistance on the camming surfaces of the plastic latch hooks. These hooks can also be sheared, partially or completely, if the edges of the module P.C. board are sharp. Shearing would also occur if the module P.C. board is excessively long and drives the latch against the latch stop. This latch sop on conventional plastic housings is to prevent the latch from being overstressed, however, if deflection is retarded at a certain point and the hook is placed in shear.

The plastic latches can also be broken if the outward load is excessive, such as impact against the module, or if the operator pulls outward before deflecting the latches enough to disengage the hook from the edges of the modules. Since these connectors are designed for approximately twenty-five insertions and withdrawals, the likelihood of excessive loads being placed on the plastic latches is significant. Stress relaxation is also more of a problem with plastics, suitable for use with single in line modules, than for more resilient materials. Slight permanent set also occurs during the first cycle to full deflection of the plastic latch. Slight set during the additional (24) cycles can also occur. Consequently, as the memory module circuit panels can vary in size, and still fall within the tolerance limits for the connector, it is possible that a relatively large board will be inserted into the slots, and then be followed by a relatively small board. The insertion of the large board into the slot can cause the plastic latch to take a permanent set, so that as the small board is inserted, the latch will not be effective in maintaining the board in the slot, resulting in an ineffective connector.

Another problem with insulative housings having integrally molded latch members and securing members is that not all insulative materials, otherwise suitable for socket housings, can be used to mold housings having deflectable latch arms and rigid securing tabs. Typically, the plastics suitable for use in a connector housing with deflectable integrally molded latch arms, are more expensive than other materials. Plastics that would provide molded latches that would exhibit toughness and resiliency, and little permanent set at room temperatures can lose those performance requirements when subjected to elevated temperatures. It is essential the connector body of the single in line memory module connectors or sockets remain stable, without distorting under load. There are liquid crystal polymers which do meet the performance criterion for single in line memory module connector housings. Quite often, additional care must be taken in molding such materials, resulting in additional expense as part of the mold tooling or the cycle of the molding operation. For example, U.S. patent application No. 07/234,362, filed Aug. 18, 1988, discloses steps necessary to mold integral members extending at right angles to the direction of flow of a liquid crystal polymer used in a single in-line memory module socket of this type. Elimination of these orthogonally projecting members, such as integrally molded plastic latches, would simplify the molding of the insulative housings and might even result in the use of less expensive plastics which do not exhibit the resilience otherwise required.

A problem also exists with housings which have securing tabs formed of plastic. The securing tabs cooperate with openings of the daughter board to positively insert the daughter board in the housing and maintain the board therein. Over many cycles, the plastic securing tabs will wear, thereby causing the securing tabs to be ineffective.

One option which avoids the need to use integrally molded plastic latches, is the use of separate metal latch formed of the spring material. A greater deflection is obtained with less set with a metal latch. A metal latch is less likely to shear and wear will be minimal. U.S. patent application No. 07/313,261 filed Feb. 21, 1989. The compliance of that latch is, however, restricted by the fact that is partially anchored at its base. Another problem is that the forces placed upon a metal latch of this type during insertion of the single in-line memory module into the socket and as a result of the movement placed upon the electronic module by the terminal spring contacts, must be transmitted to a relatively fragile housing. The fragility of the housing is in part due to the dimensional constraints placed upon the socket, which results in the necessity to use relatively thin sections in the insulative housing.

A metal latch member, having sufficient compliance for use in a single in-line memory module and permitting simplification of the configuration of the molded insulative housing is therefore quite desirable. The instant invention provides just such a resilient metal latch for use in a single in-line memory module socket.

SUMMARY OF THE INVENTION

BRIEF DESCRIPTION OF THE INVENTION

DETAILED DESCRIPTION OF THE INVENTION

Figure 1:
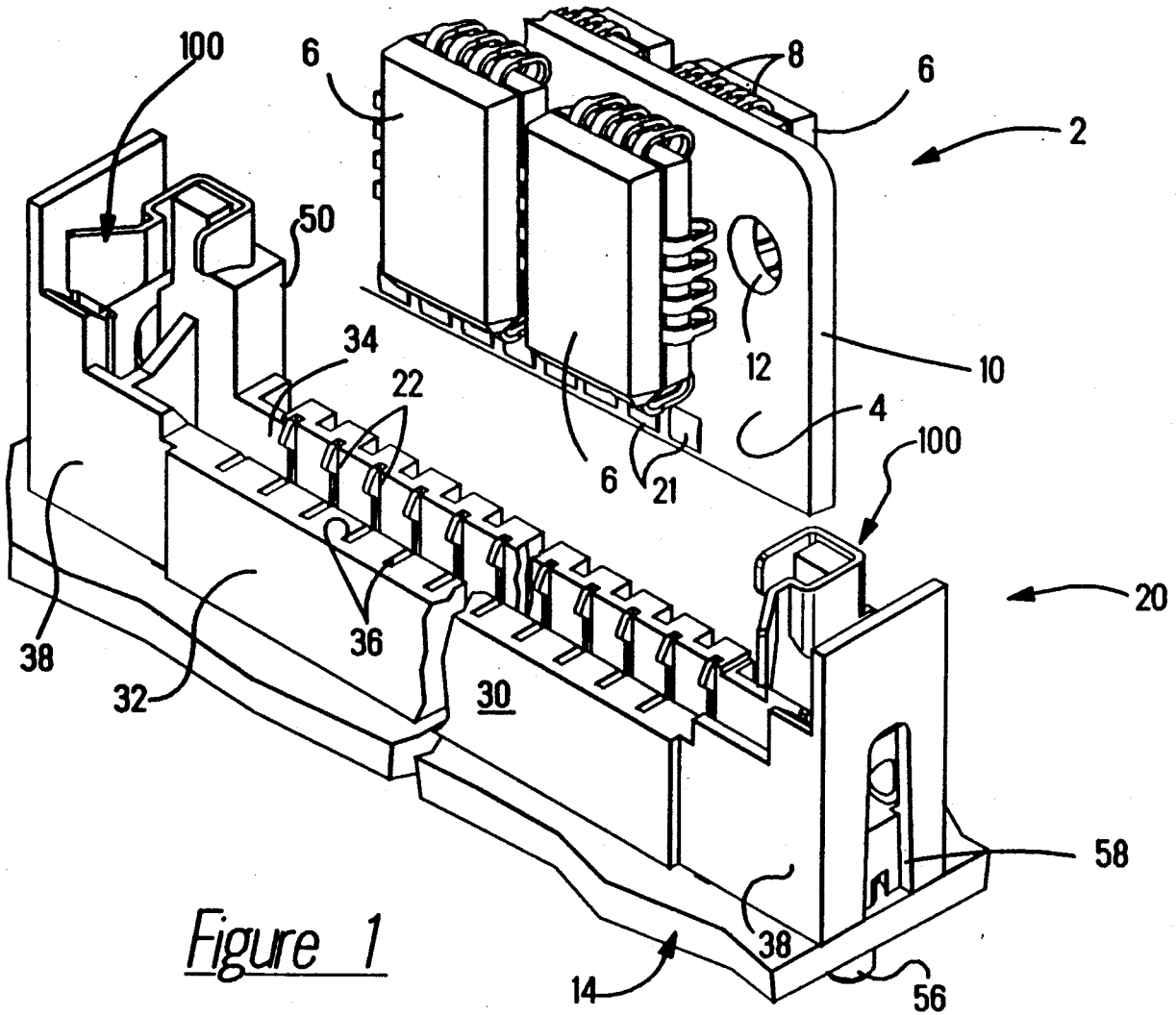
FIG. 1 is a perspective view of one embodiment of a single in-line memory module socket having integral latches at each end.

An electronic module 2, such as a single in-line memory module or board is shown in FIG. 1, has a circuit panel 4 having a plurality of integrated circuit components 6 secured to one or both sides of the circuit panel 4 by leads 8. Integrated circuit components 6 can comprise random access memory packages such as J-leaded packages. Each circuit panel 4 has a hole 12 located along each edge 10. These circuit panels 4 are normally manufactured in accordance with JEDEC standards. Although JEDEC standards are applicable to single in-line memory modules, it should be understood that many modules of this type may be manufactured in such a way that they are not in strict compliance with applicable standards. For example, the thickness or length of the individual circuit panels 4 may not be in compliance with JEDEC standards. This non-uniformity does cause some problems in assuring that a single socket can handle the entire range of modules with which it might be used.

Socket 20 is used to interconnect an electronic module 2 to a printed circuit board 14. Each socket 20 has an insulative housing 30 with a plurality of terminals 22 positioned therein. Terminals 22 establish electrical contact between connecting pads 21 on the circuit panel 4 and the printed circuit board 14. The details of the particular contact terminals 22 are not part of the inventive subject matter of this socket. These contacts can be of the type shown in U.S. Pat. No. 4,737,120, incorporated herein by reference. These terminals can also be of the type shown in U.S. patent application 07/398,795 filed Aug. 24, 1989, also incorporated herein by reference.

Insulative housing 30 comprises a one piece molded member formed of a suitable insulative material. A liquid crystal polymer can be used to mold the insulative housing 30. Other materials such as polyphenylene sulfide, also known as Ryton, a trademark of Phillips Petroleum Company, might also be used to fabricate this insulative housing 30. Housing 30 has a central body 32 extending between right and left support members 38. The central body 32 has a plurality of terminal cavities 36 which intersect a central slot 34. The electronic module 2 is received within the slot 34. In order to position the electronic module 2 in the slot 34, the circuit panel 4 of the module 2 is inserted into the slot 34 and the module is rotated to an upright position. Again the configuration of the slot 34 and the intersecting terminal cavities 36 does not in and of itself comprise the subject matter of this invention. The configuration of the terminal cavities 36 and the slot 34 can be chosen to correspond with the specific terminal 22 employed therein.

Figure 2:
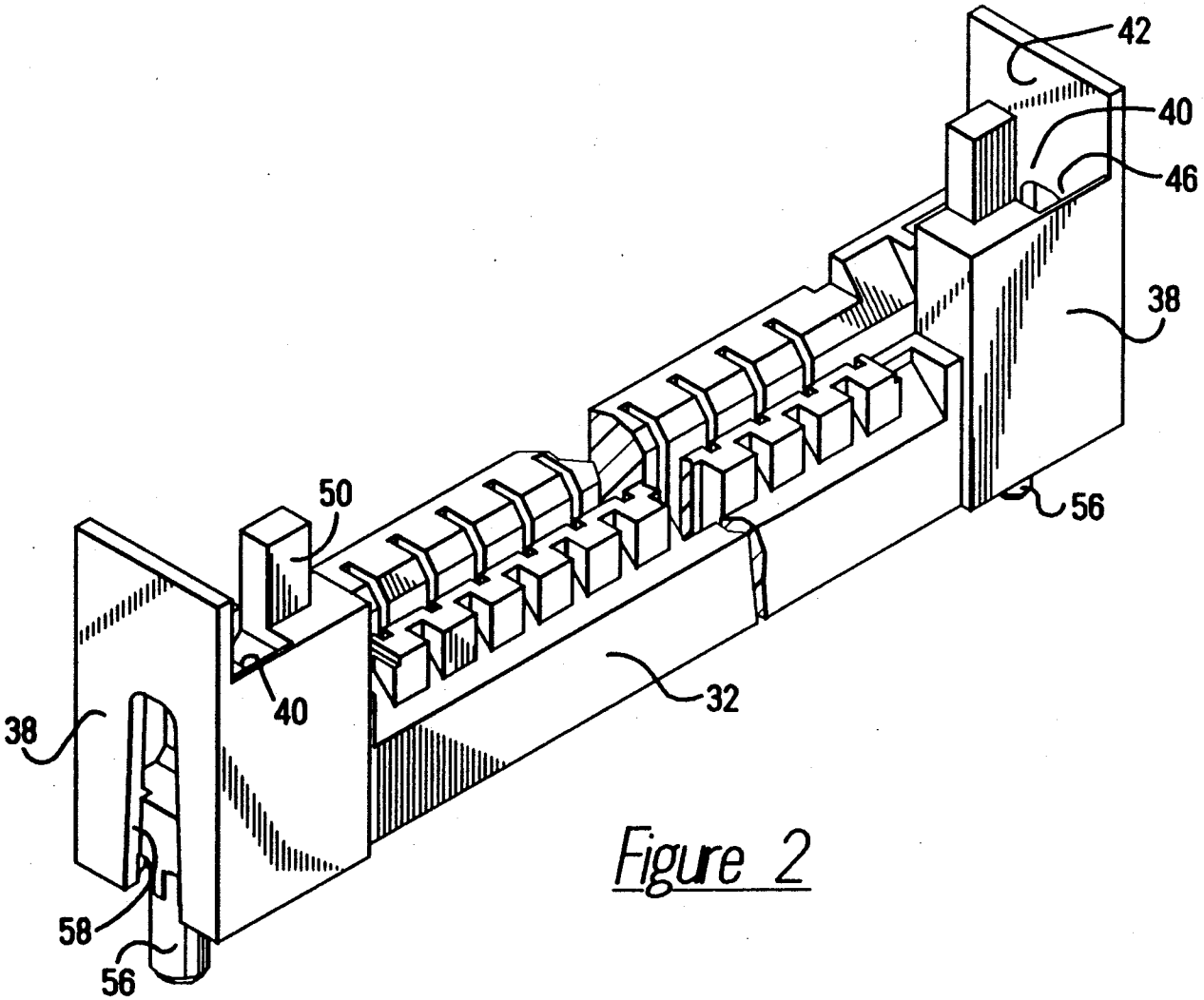
FIG. 2 is a perspective view showing the rear of the insulative housing of the socket shown in FIG. 1.
Figure 4:
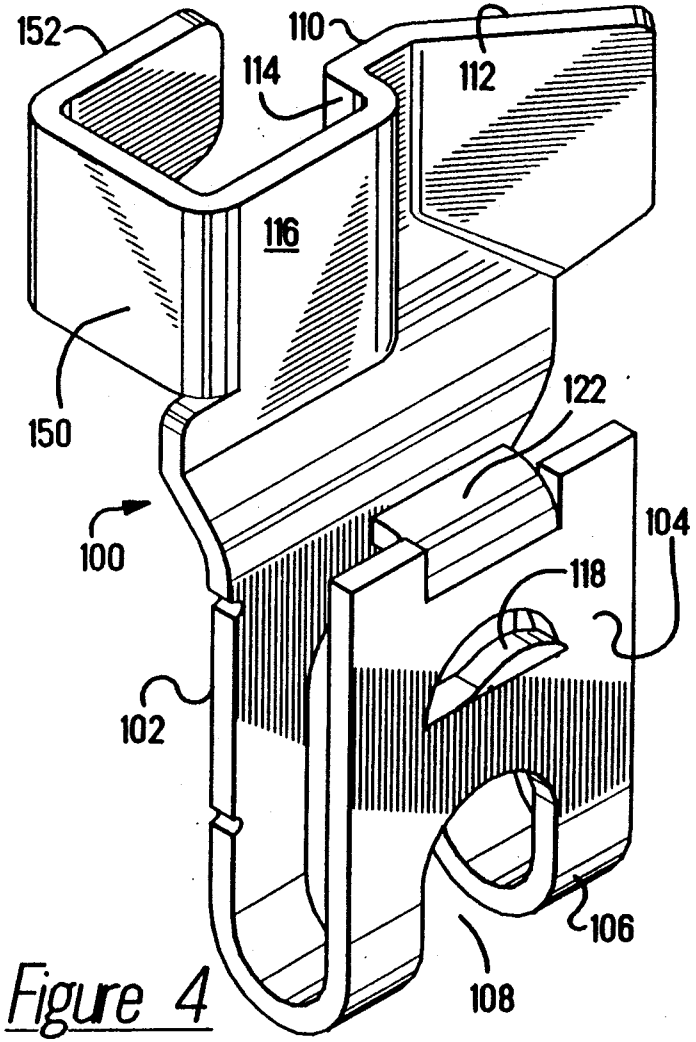
FIG. 4 is a perspective view showing the rear of the latch shown in FIG. 3.
Figure 3:
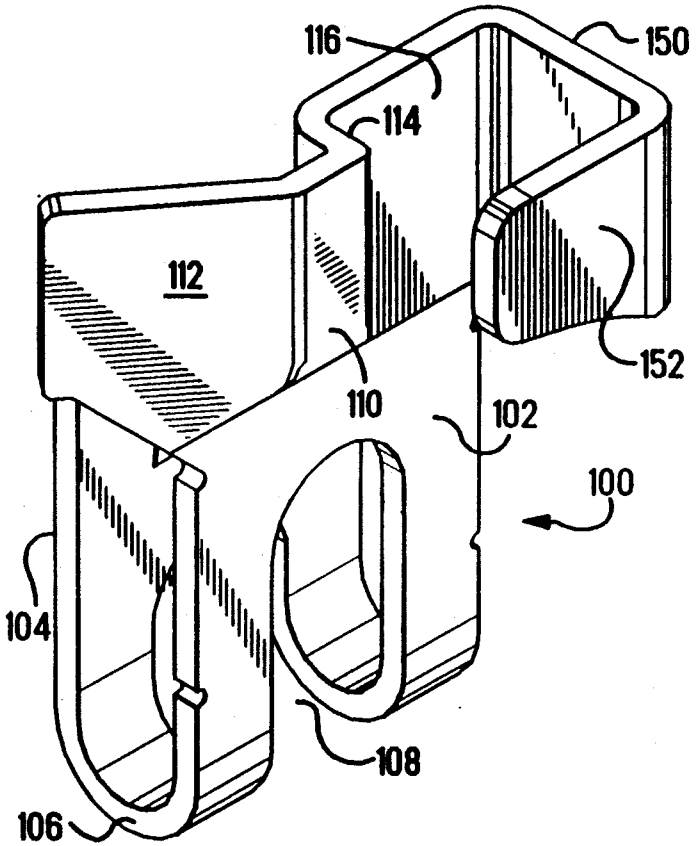
FIG. 3 is a perspective view of the latch which is positioned in the module socket of FIG. 1.
Figure 6:
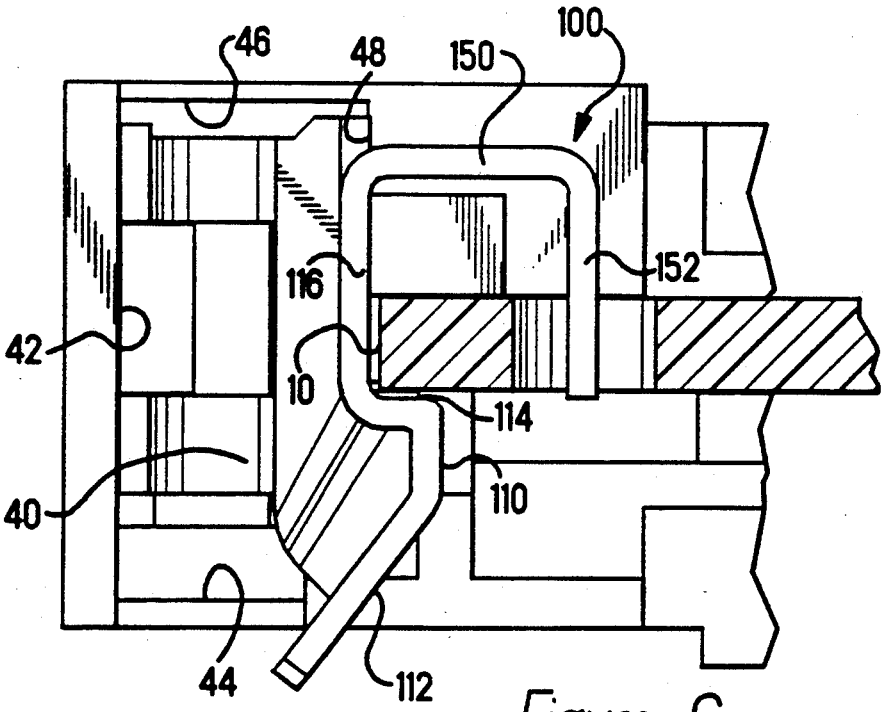
FIG. 6 is a partial top view, similar to that shown in FIG. 5, which illustrates the position of the first alternate latch after the memory module has been fully inserted into the socket.
Figure 7:
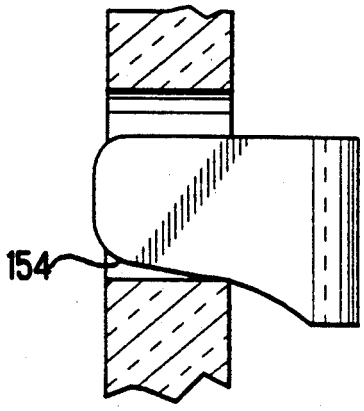
FIG. 7 is a partial cross-sectional view of an end of the latch positioned in an opening of the memory module.

Each of the support member 38, which comprise an integral part of the insulative housing 30, contains a pocket 40 extending inwardly from the upper surface of the insulative housing 30 toward the lower surface, as best seen in FIGS. 2, 6, and 7. Each pocket 40 is bounded by an endwall 42, a front wall 44, a backwall 46 and a interior wall 48, each of which comprises an integral part of the housing 30. The front wall 44 and the backwall 46 extend parallel to the slot 34 along the portion of the length of the housing 30. Endwall 42 extends generally perpendicular to the slot 34. The interior wall 48 extends from the backwall 46 toward the front wall 44 but is separated from the front wall 44 by a recess which cooperates with the module 2 positioned within slot 34 extends. The interior wall 48 therefore extends over only a portion of the pocket 40. Interior wall 48 is parallel to and spaced from the adjacent endwall 42. The recess or the interior wall provides communication between the slot 34 and the pocket 40. In this manner the slot 34 communicates with the pocket 40 beyond the interior wall 48 while at the same time permitting the pocket 40 to be bounded on four sides by at least part of an integral housing wall. Each pocket 40 is upwardly open but is bounded by a lower surface from which the respective walls extend upwardly. The endwall 42 has a groove 58 extending upwardly from the bottom. This groove 58 forms an opening which communicates to the interior of the pocket 40.

An upwardly extending projection 50 is located adjacent each pocket 40. This upwardly extending projection 50 extends upwardly from the backwall 46 so that it is formed on one of the walls defining the pocket 40. The upwardly extending projection 50 is set back from the exterior of the backwall 46 to define a shoulder behind the upwardly extending projection 50. The shoulder 54 extends along the rear of projection 50. Each support 38 includes a pocket 40 and the respective walls defining these pockets comprise mirror images of each other, since one is located on the left and the other is located on the right of the insulative housing 30. The insulative housing 30 is positioned within a printed circuit board 14 by mounting pegs 56 extending from the bottom of the housing 30.

The plurality of terminals 22 positioned within the cavities 36, are configured to establish electrical contact with the connecting pads 21 on the module 2 upon rotation of the module to a first or upright position. Each of the terminals 22 will apply a moment to the module when the module is in the upright first position. In order to resist the moment applied to the module 2 by the terminals 22, a U-shaped latch 100, which comprises means for holding the module in the first position and resisting the moment applied by the module by the terminals, is positioned within each pocket 40. In the preferred embodiment of this invention a latch 100 is located on each end of the housing 30, but it should be understood that for a least some applications a single latch located on one end may be sufficient. The U-shaped latch 100 comprises a separate member formed of a spring metal. It should be understood that in some applications a separately molded U-shaped latch could be employed. Use of a plastic U-shaped latch might be suitable where the insulative housing is manufactured from a relatively inflexible plastic whereas the latch might be manufactured from a resilient, and therefore more expensive, plastic. In conjunction with the pocket 40, and the supports 38, the U-shaped latch 100 comprises the means for holding the module in the first position. The U-shaped latch 100 is secured to the endwall 42. In the undeflected state, however, the U-shaped latch engages both the endwall 42 and the interior wall 48.

The U-shaped latch 100 comprises an inner leg 102 joined to an outer leg 104 by a intermediate bight section 106 which is located at the bottom of the U-shaped latch. The inner leg 102 engages the interior wall 48 when the latch is in the undeflected configuration. The outer leg 104 is secured to the housing at a point adjacent to the upper end of the latch. Upon deflection of the U-shaped latch 100 by engagement of a wedge shaped projection 110 located at the top of the inner leg 102, with the module 2, during rotation of the module, the U-shaped latch is stressed throughout its length between the wedge shaped projection and the point of attachment between the outer leg 104 and the housing, therefore forming a compliant spring. The U-shaped latch 100 is inserted into its corresponding pocket 40 from the top of the housing and the latch is positioned so that the bight is positioned above the lower surface of the pocket 40 and such that the bight is unrestrained by the lower surface during deflection of the latch 100. In order to make the latch 100 more resilient, a central cutout 108 extends through the bight 106 and into each of the legs 102 and 104.

Figure 5:
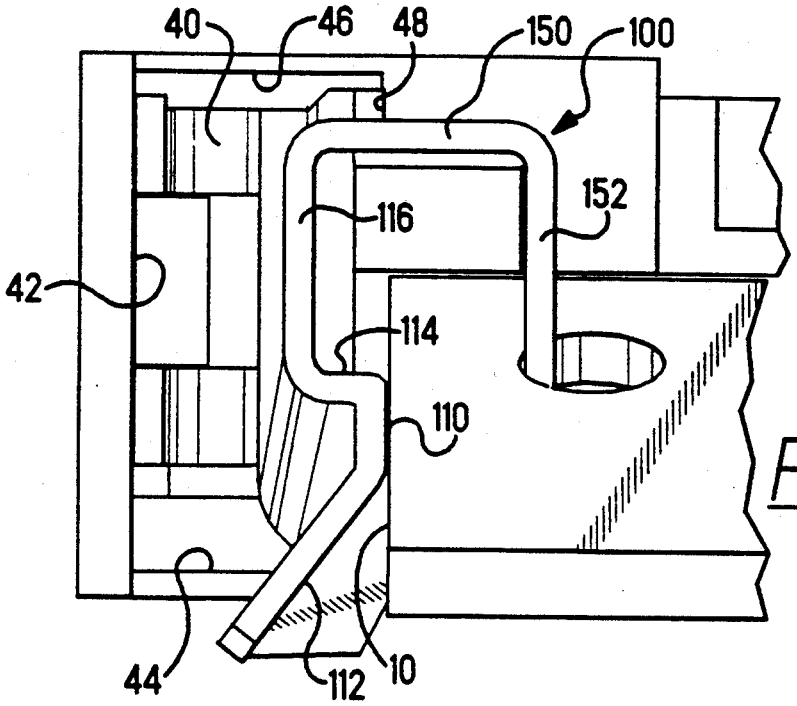
FIG. 5 is a partial top view of a socket which illustrates the manner in which the single in-line memory module is rotated into position in a socket which has a first alternate latch provided therein.

Each latch 100 includes a wedge shaped projection 110 located at the upper end of the inner leg 102. It is this wedge shaped projection 110 which engages an edge 10 on the circuit panel 4 of an electronic module 2. As best shown in FIG. 5, the U-shaped latch 100 is deflected by the module as the module is rotated into the first position and during this rotation, the edge of the module 2 engages the wedge shaped projection 110. During rotation of the electronic module 2, each of the latches 100 is deflected outwardly at the end of the slot 34. Once the electronic module reaches the upright first position, the U-shaped latch 100 holds the electronic module in the housing in engagement with the terminals, as shown in FIG. 6.

The wedge shaped projection 110 comprises a deep drawn section of the stamped and formed latch 100 and is located adjacent the forward end of the U-shaped latch 100. Wedge shaped projection 110 protrudes from the top of the pocket 40 and includes a forward surface 112 which is inclined toward the outer leg 104. A smooth surface which will not damage the edge of the circuit panel is thus formed at the front of the wedge shaped projection 110. A rear stop surface 114 located immediately rearward of the forward inclined surface 112, extends perpendicular to the outer leg 104. This rear stop surface 114 is, however, located on the inside surface of the wedge shaped section 110. Rear stop surface 114 is joined to a first flat section 116 which is located immediately rearward of the stop surface 114. Rear stop surface 114 extends perpendicular to the first flat section 116 which in turn extends rearwardly from the stop surface 114. First flat section 116 is parallel with the outer leg 104. The length of this first flat section 116 is sufficient such that when the module 2 is in its first upright position, the edge 110 of the module is positioned adjacent the first flat section 116.

A second flat section 150 is located at the rear end of the flat section 116. Second section 150 extends inwardly from the first section 116 and is generally perpendicular to the first section 116. Second section 150 is perpendicular to the stop surface 114 and is spaced from the stop surface by a distance sufficient for receipt of not only the module 2 but also a portion of the upwardly extending projection 50 between the stop surface 114 and the second section 150. With the U-shaped latch 100 positioned within pocket 40, the second section 150 is wrapped around at least a portion of the upwardly extending projection 50 so that the upwardly extending projection 50 provides support for the U-shaped latch. The backwall 46 and the upwardly extending projection 50 are generally sturdier than the other walls defining the pocket 40. In particular, the upwardly extending projection 50 located on backwall 46 is sturdier than the relatively thin endwall 42. By wrapping the second section 150 around this upwardly extending projection 50, additional support is provided to the U-shaped latch 100 as this latch resists the moment applied to the modules 2 by the terminals 22. The second section 150 is positioned behind the projection 50 and on top of the shoulder 54. During deflection of the U-shaped latch 100 the second section 150 is free to move along the rear of the upward extending projection 50 and along the shoulder 54.

A third section or securing tab 152 extends from the end of the second flat section 150. The securing tab 152 is generally perpendicular to the second section 150, and generally parallel to the first section 116. As best shown in FIGS. 5 and 6, the securing tab 152 is wrapped around at least a portion of the upwardly extending projection 50. The configuration of the securing tab 152 positions the tab 152 transverse to the slot 34 and above the slot 34 and pocket 40. The tab 152 is dimensioned to be received within one of the holes 12 on the circuit board 2.

It is important to note that the tab 152 and first section 116 are spaced apart by a distance which is greater than the width of projection 50, thereby allowing the wedge shaped projection 110 to move relative to the projection 50.

The U-shaped latch 100 is insertable into the pocket 40 from above. A barb 118 formed outwardly on the outer leg 104 is received within the groove 58 on the endwall 42 when the U-shaped latch 100 is fully inserted into the pocket 40. Interengagement between the barb 118 and the groove 58 thus prevents the U-shaped latch from being inadvertently dislodged from the pocket 40 and also provides a fixed point adjacent to upper end of the latch on the outer leg 104. In this position the entire U-shaped latch 100 is free to deflect between the point of engagement of barb 118 and groove 58 and the relatively inflexible deep drawn wedge section 110. Note that the U-shaped latch 100 deflects by movement of the inner leg 102 towards the outer leg 104. While the endwall 42 is sufficient to withstand the forces applied to the U-shaped latch 100 during deflection, the moment applied to the latch by engagement of terminals 22 to the module 2 can provide a greater force which, due to the relatively thin configuration of endwall 42 cannot be resisted by the endwall alone. The U-shaped latch can be flexed until the overstress member 122 extending inwardly from the top of the outer leg 104 engages the inner leg 102, the endwall is not required to provide the only support for the latch 100 when the module is in the first position, fully engaged with the terminals. Note that the maximum moment applied to the module 2 by the terminals 22 occurs only after the module is rotated to its upright position and the latch has fully engaged the edge of the board along the rear stop surface 114 on the wedge section 110.

As the board 2 is rotated to the locked position, the board cooperates with the latch 100. As the board is initially rotated, as shown in FIG. 5, the edge 10 of the board engages the wedge section 110 of the latch 100, causing the wedge section to move toward the end wall 42. This movement of the wedge section is controlled by the overstress member 122, as described above, and by the cooperation of the tab 152 with the projection 50. As shown in FIG. 5, the inside surface of the tab 152 may engage projection 50 when the board is rotated, thereby controlling the movement of the latch and preventing the latch from taking a permanent set.

The configuration of the end of the tab 152 allows the tab to move in the opening 12 to the position shown in FIG. 5. The end of the tab has a tapered configuration which allows the tab to move freely in the opening, without damaging the sidewall of the opening.

Referring to FIG. 6, as the board 2 reaches the fully rotated position, the edge 10 of the board is moved beyond the wedge 110 thereby allowing the wedge portion 110 to be resiliently returned to its original position. In this position, a surface of the first section 116 engages the projection 50. Tab 152 is moved away from the projection, and is positioned essentially in the center of the opening 12 of the board.

It is worth noting that as the board is rotated from the position shown in FIG. 5 to the position shown in FIG. 6, the bottom surface 154 of the tab 152 cooperates with the surface of the opening 12 to more fully force the board into the slot 34. The rotation of the board will cause the surface of the opening to engage the bottom surface 154 of the tab 152. As the bottom surface 154 is angled, the rotation of the board will translate into a downward force applied to the board, causing the board to be fully inserted in the slot. Therefore, the bottom surface of the tab cooperates with the surface of the opening to ensure that the board is properly seated in the slot.

FIGS. 8 through 12 show a second embodiment of the invention. The basic function of the latch 200 is essentially identical to that described for latch 100 with several exceptions.

Figure 8:
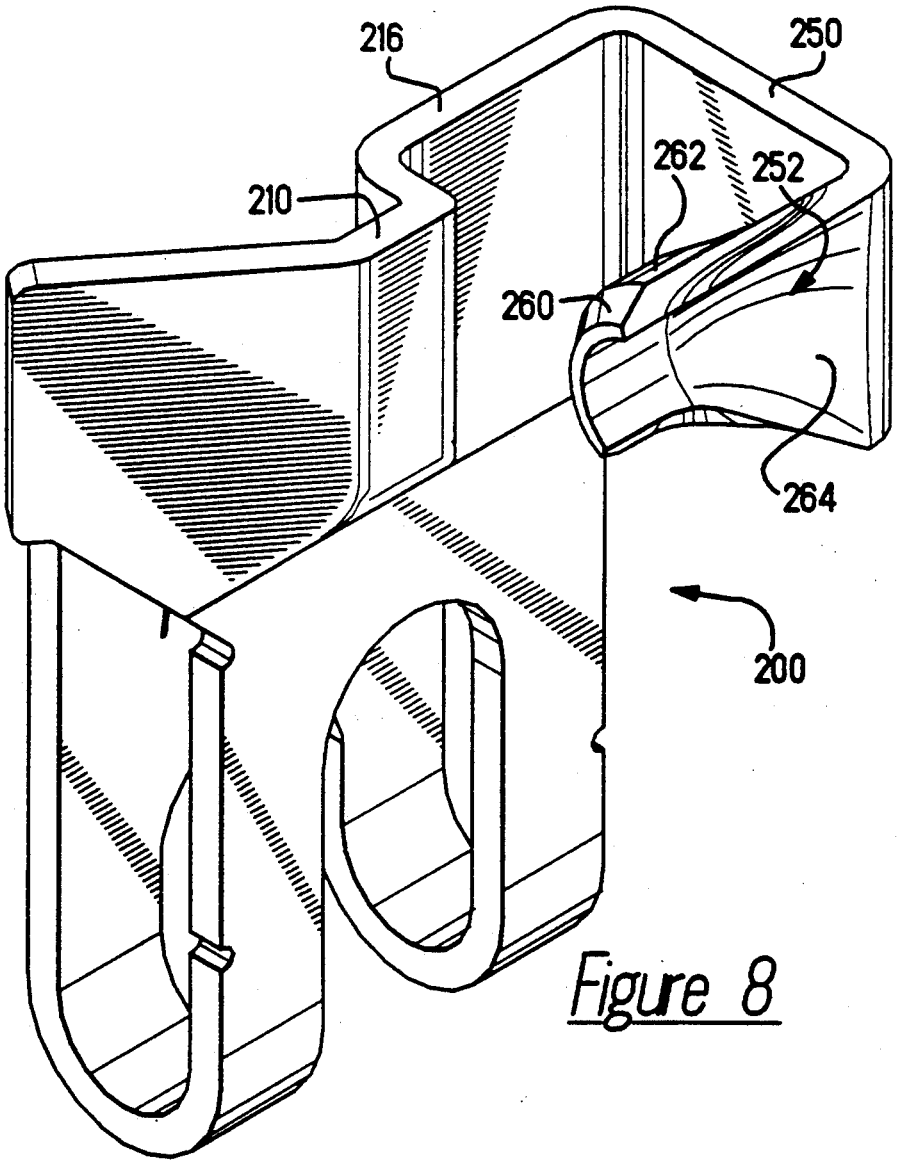
FIG. 8 is a perspective view of a second alternate latch which is to be positioned in a module socket similar to that of FIG. 1.
Figure 9:
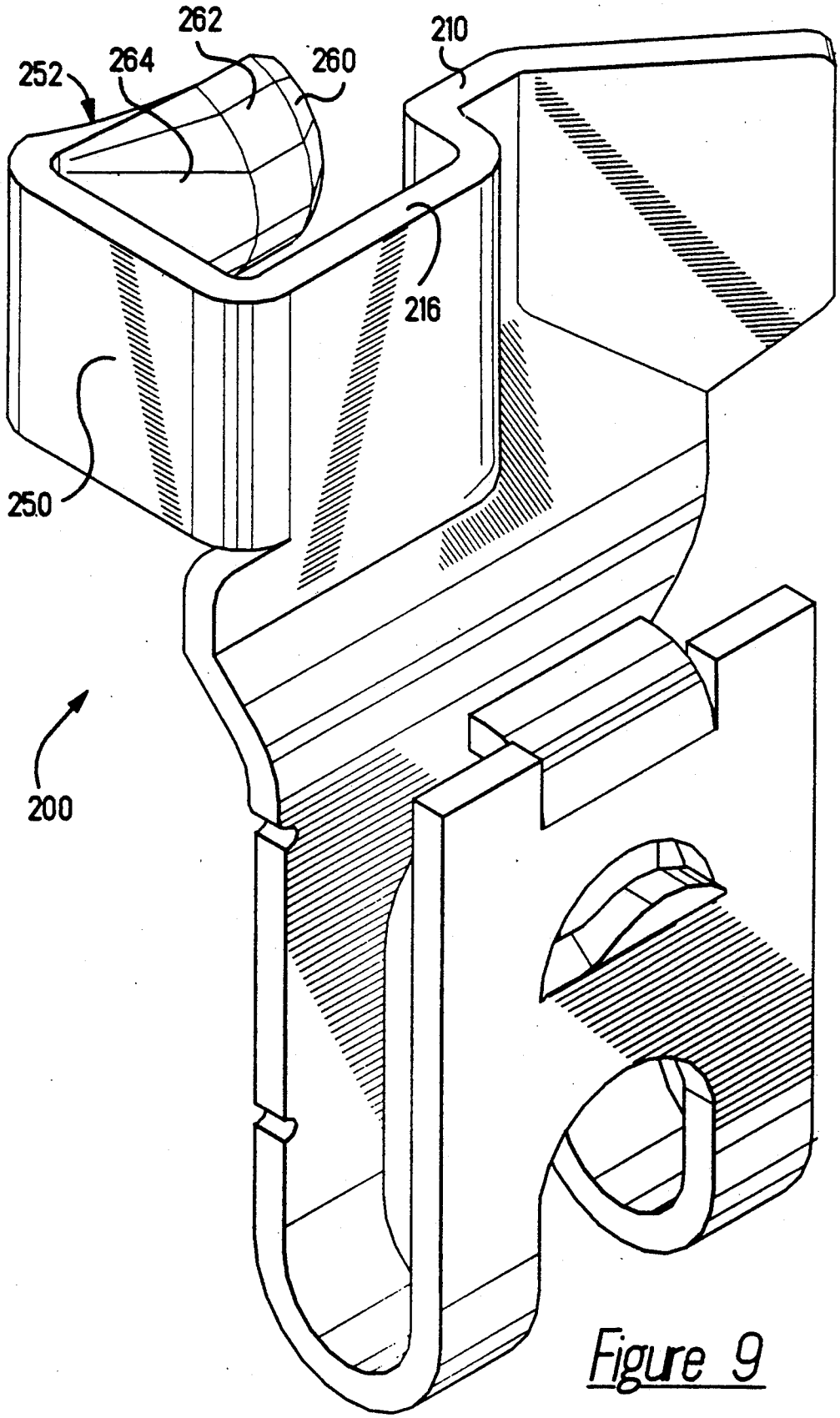
FIG. 9 is a perspective view showing the rear of the latch shown in FIG. 8.
Figure 12:
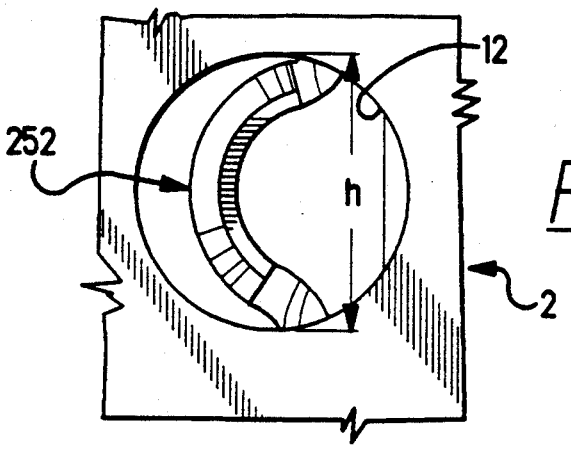
FIG. 12 is a partial plan view showing an end of the second alternate latch positioned in an opening of the memory module.

Tab 252, as best shown in FIGS. 8 and 12, is formed to have an arcuate configuration proximate the free end thereof. The arcuate shape of the free end is dimensioned so that the free end cooperates with the opening 12 of the board 2, as will be more fully described.

Figure 10:
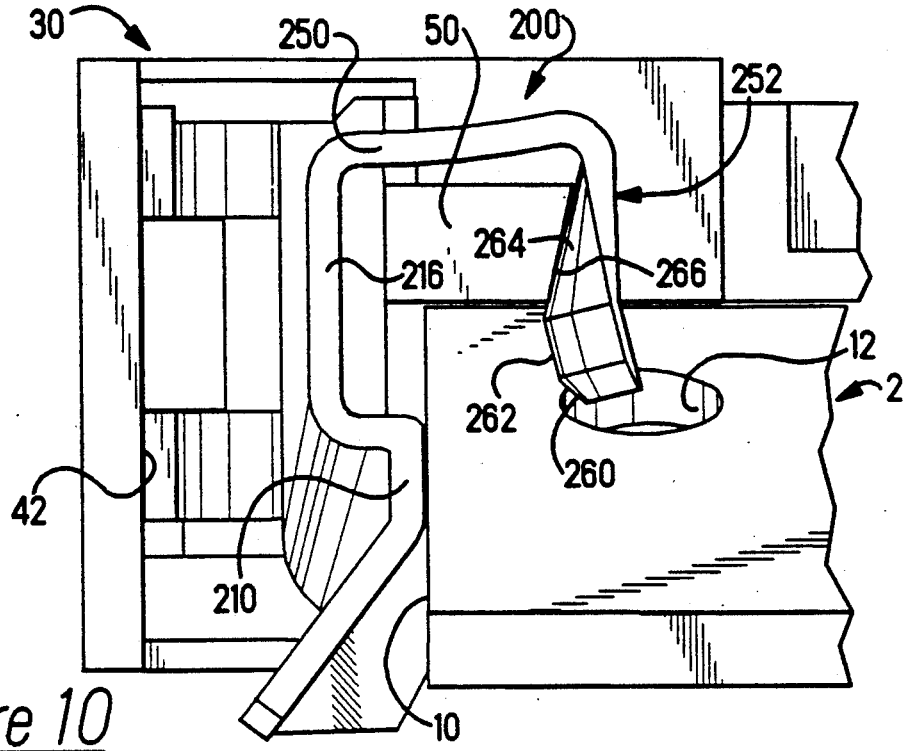
FIG. 10 is a partial top view of a socket which illustrates the manner in which the single in-line memory module is rotated into position in a socket which has the second alternate latch provided therein.
Figure 11:
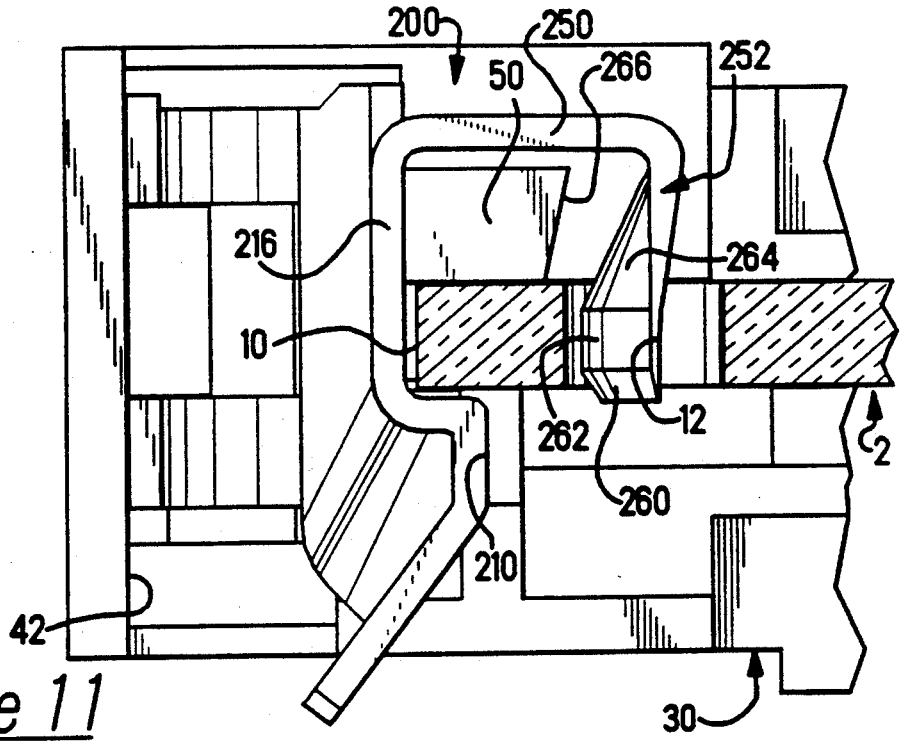
FIG. 11 is a partial top view, similar to that shown in FIG. 10, which illustrates the position of the second alternate latch after the module has been fully inserted into the socket.

The tab 252, as best shown in FIGS. 10 and 11, has a lead-in portion 260, a board mounting portion 262, and a pivoting portions 264. As the board 2 is rotated form the first position to the second position, the edge 10 of the board cooperates with the wedge shaped projection 210, causing the wedge shaped projection 210 to move toward the end wall 42. As the wedge shaped projection 210 is moved, the tab 252 is also forced to move toward end wall 42. The unrestricted movement of tab 252 continues until the pivoting portion 264 engages an angled surface 266 of projection 50. The engagement of pivoting portion 264 with angled surface 266 causes the tab 252 and the second section 250 to pivot about the end of the first section 216, as shown in FIG. 10. The pivoting ensures that the lead-in portion 260 and the board mounting portion 262 will be spaced to be positioned in the center of the opening 12 when the board is moved toward the second position. The positioning of the lead-in portion and the mounting portion in the center of the opening when the board is in the first or the second position allows the height h of the mating portion to be approximately equal to the diameter of the opening.

It is important that the height h of the mating portion 262 be maintained as close as possible to the diameter of the opening 12. If the diameter and height are essentially identical, the board will not be allowed to move in a horizontal direction relative to the housing 30 when the board is fully inserted (second position), thereby ensuring that the contacts of the housing and the pads of the board will be maintained in electrical engagement.

Figure 13:
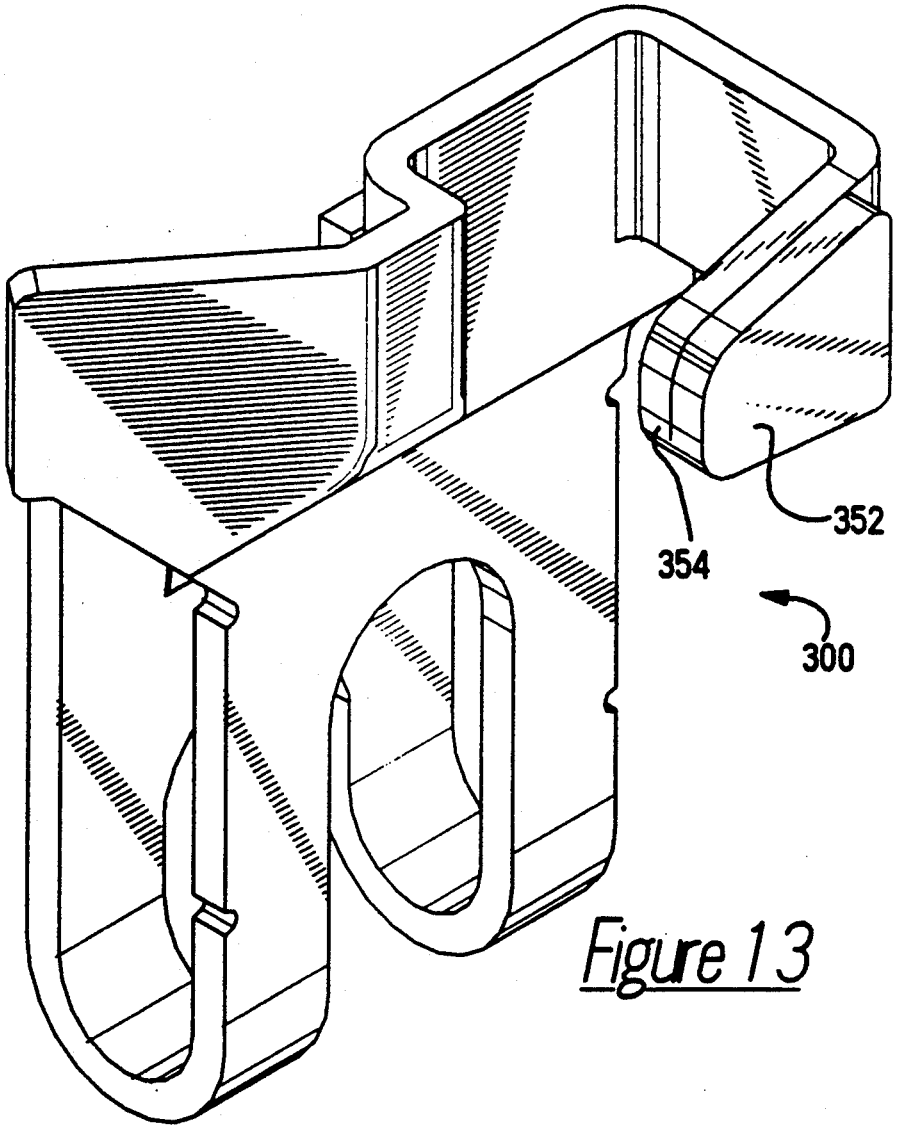
FIG. 13 is a perspective view of a third alternate latch which is to be positioned in a module socket similar to that of FIG. 1.
Figure 14:
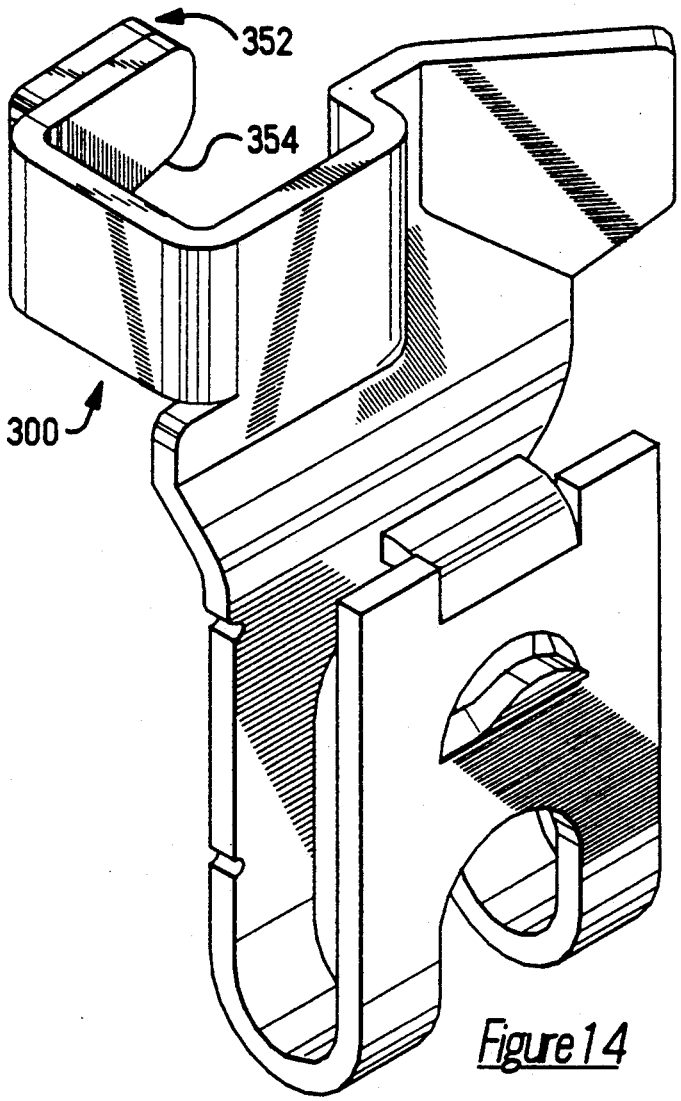
FIG. 14 is a perspective view showing the rear of the latch shown in FIG. 13.
Figure 15:
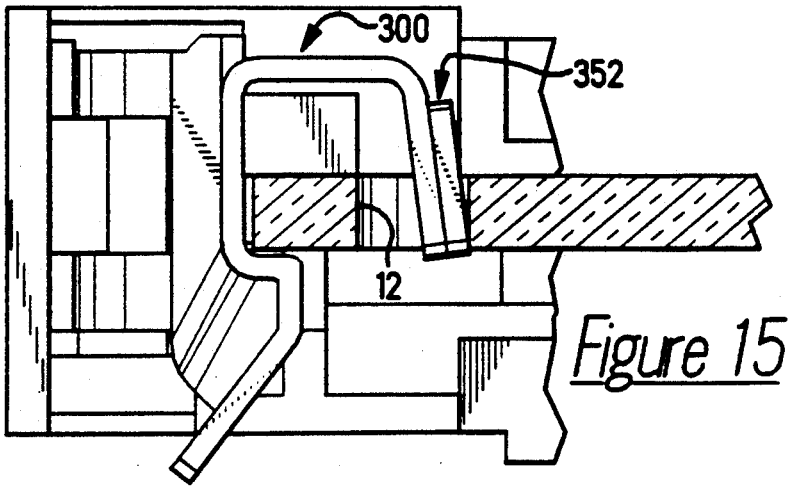
FIG. 15 is a partial top view of a socket which illustrates the position of the third alternate latch after the module has been fully inserted into the socket.

FIGS. 13 through 15 illustrate a third embodiment of the invention. The basic function of latch 300 is essentially identical to that of latch 100 with several exceptions.

Tab 352, as shown in FIG. 15, extends from second section 350 at an angle (obtuse) which is not perpendicular to the second section. The tab 352 is angled so that the end of the tab 352 will be offset from the center of opening 12 when the board is provided in the second position. It should be noted that the end of the tab is positioned at approximately the center of the opening when the board is in the first position.

As best shown in FIGS. 13 and 14, the tab is formed to provide the tab with a double thickness. The tab is formed such that the material is bent about the bottom surface 354. This provides the bottom surface with a relatively smooth surface which will not deform the side surface of the opening when the board is rotated from the first position to the second position.

Figure 16:
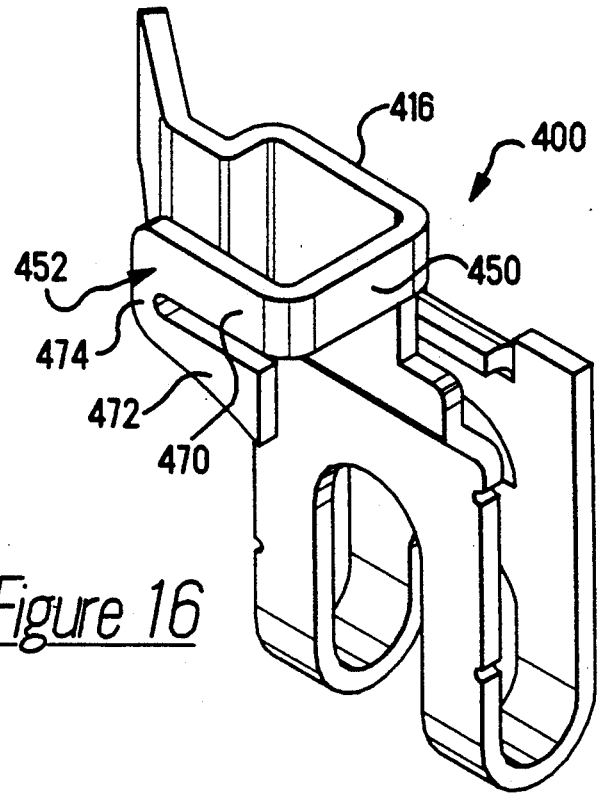
FIG. 16 is a perspective view of a fourth alternate latch which is to be positioned in a module socket similar to that of FIG. 1.
Figure 17:
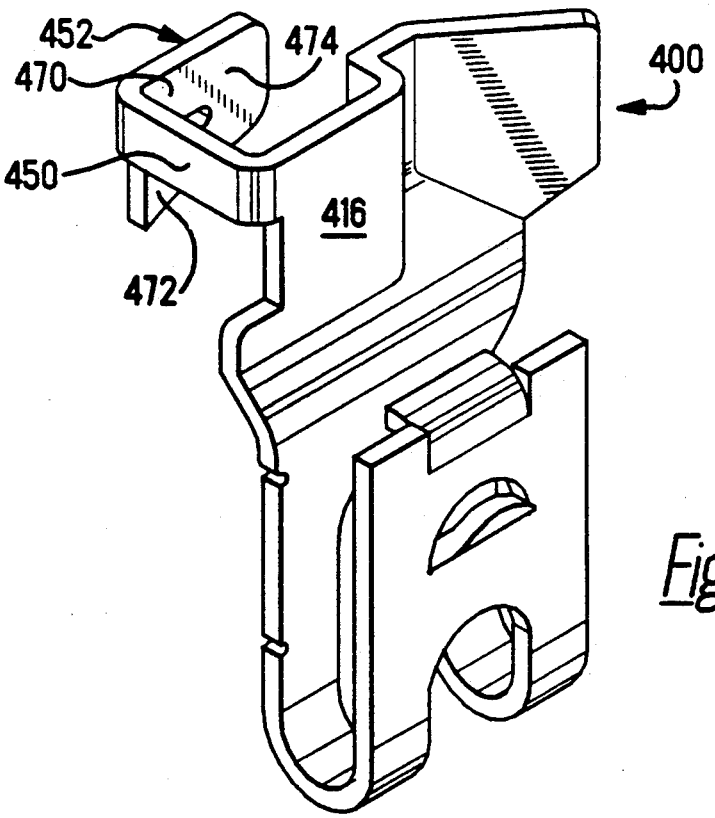
FIG. 17 is a perspective view showing the rear of the latch shown in FIG. 16.
Figure 18:
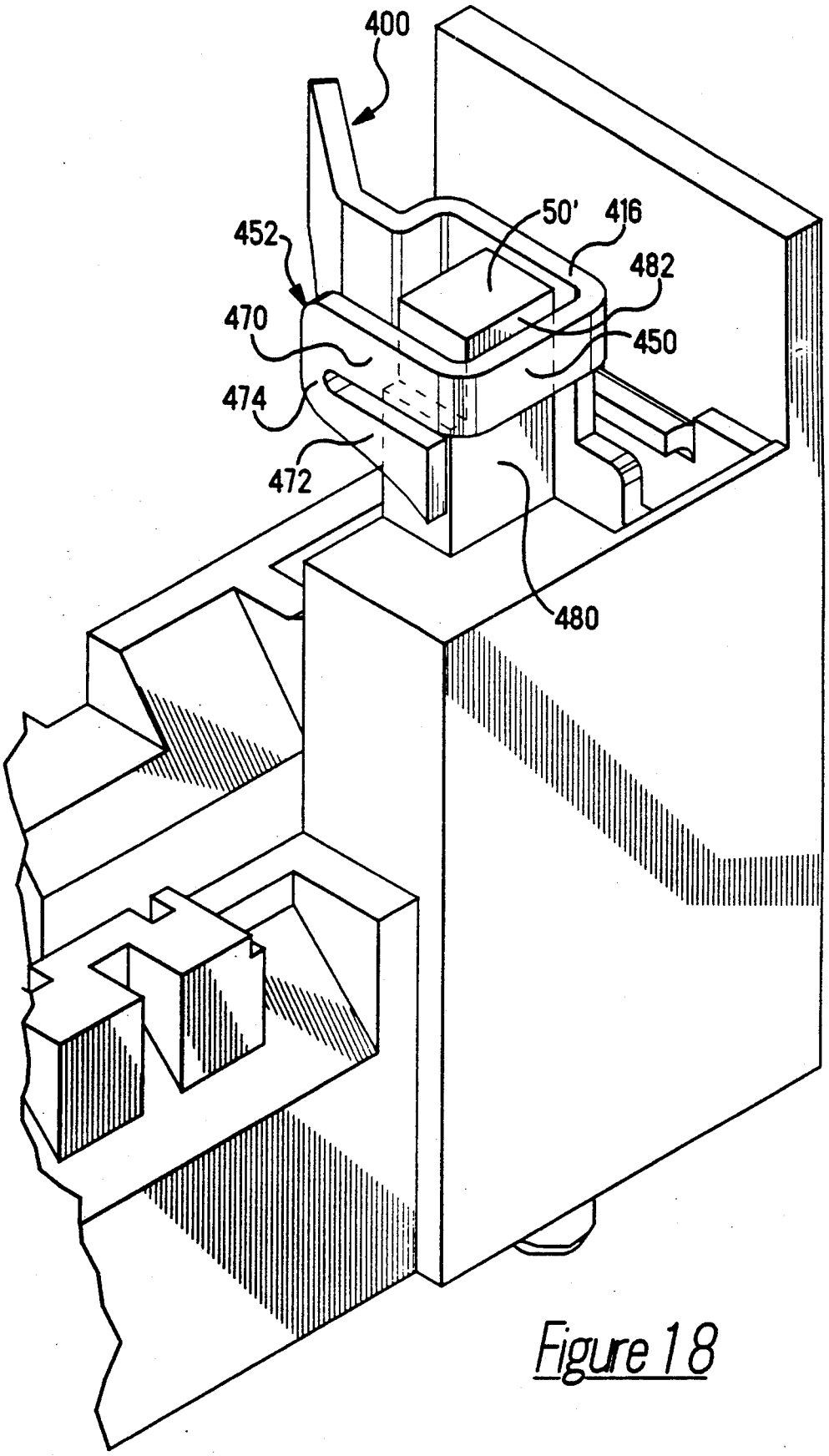
FIG. 18 is a perspective view of the latch of FIG. 16 positioned in a module socket.

FIGS. 16 through 18 show a fourth embodiment of the invention. The tab 452 of latch 400 has a first movable section 470 and a second securing section 472 secured to the first movable section by a bight 474. The first movable section 470 is connected to and extends at a right angle from second flat section 450.

As is best shown in FIG. 18, the projection 50' has a wide base portion 480 and a narrow upper portion 482. The wide base portion 480, which cooperates with the securing section 472, is configured to have essentially the same width as the space provided between the first section 416 and the tab 452. Consequently, as the board is moved from the first position to the second position the securing section 472 will remain stationary as the movable section 470 is moved.

As the securing section remains stationary, the bight 474 also remains essentially stationary. The essentially stationary nature of the bight 474 ensures that the bight 474 will be positioned proximate to the center of opening 12 as the board is moved between the first and the second position. The split configuration allows the tab 452 to have the resilient characteristics required to allow the latch 400 to move between the first and the second positions.

Figure 19:
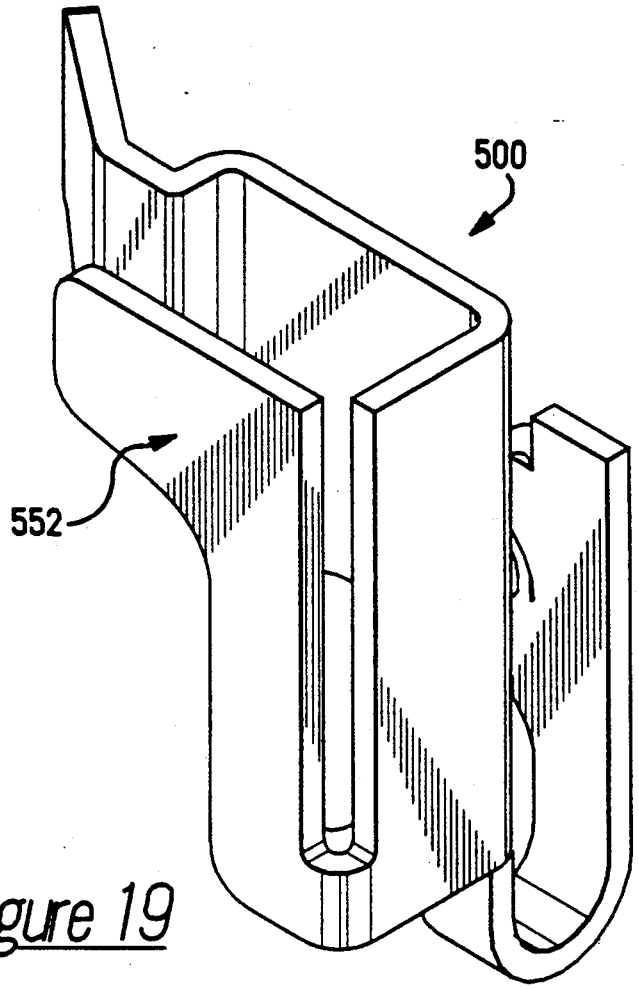
FIG. 19 is a perspective view of a fifth alternate latch which is to be positioned in a module socket similar to that of FIG. 1.

FIG. 19 illustrates a latch 500 which is similar to the latch shown in FIGS. 16 through 18. The tab 552 has a split beam configuration which provides a lengthy resilient arm which provides the latch with the resilient characteristics desired. As the resilient arm has a significant length, the end of the tab 552 can be held stationary to align the end of the tab with the center of opening 12.

Figure 20:
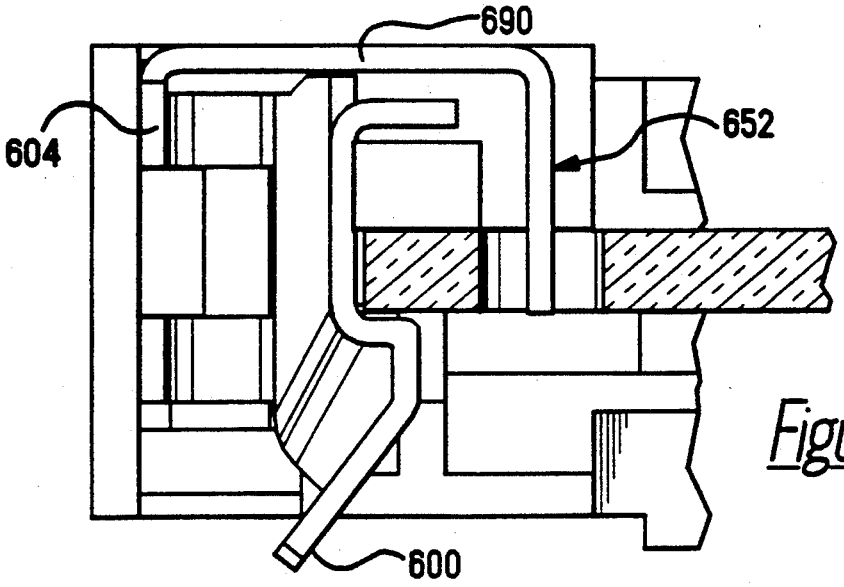
FIG. 20 is a partial top view of a socket which illustrates the position of a sixth alternate latch after the module has been fully inserted into the socket.

FIG. 20 illustrates an embodiment in which the tab 652 extends from a section 690 which extends from the outer leg 604. In this embodiment the tab 652 remains stationary as the board is rotated between the first and the second positions.

Figure 21:
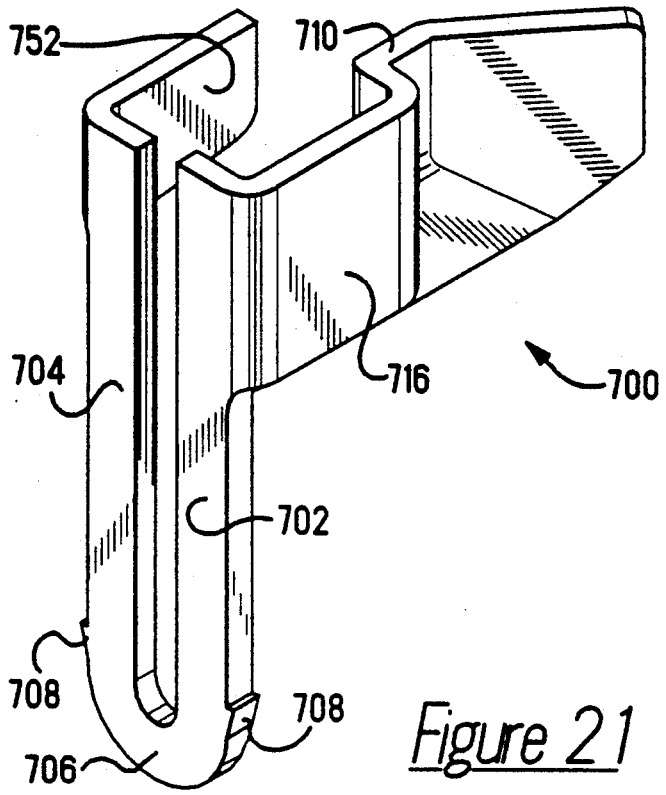
FIG. 21 is a perspective view of a seventh alternate latch which is to be positioned in a module socket similar to that of FIG. 1.
Figure 22:
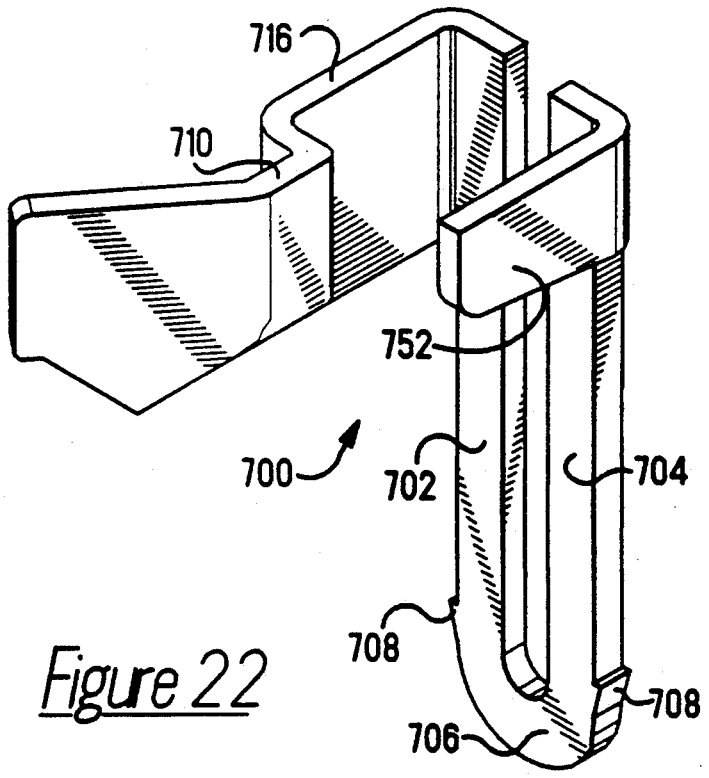
FIG. 22 is a perspective view showing the rear of the latch shown in FIG. 21.

FIGS. 21 and 22 show an embodiment in which the latch 700 has a first leg 702 and a second leg 704 which are joined together by a bight section 706. A portion of the legs 702 and 704 and the bight section 706 are positioned in a recess which is offset from and essentially parallel to the slot 34 of the housing 30. The latch 700 is secured in the recess by barbs 708.

The recess is dimensioned to allow the first leg 702 to move in a direction along the longitudinal axis of the recess. In other words, a free end of the first leg 702 can be moved relative to the second leg 704 as the electronic module 2 is rotated between the first and second positions.

Each latch 700 includes a first section 716 which is integral with and extends essentially perpendicular to the free end of the first leg 704. A sedge shaped projection 710 extends from the first leg 704. The operation of the first section 716 and the wedge shaped projection 710 is similar to that described with respect to FIGS. 1 through 7.

A tab 752 extends from a free end of the second leg 704. A portion of the tab 752 may be positioned in engagement with the housing 30 to ensure that the tab 752 will remain stationary relative to the housing. Due to the configuration of the latch 700, the tab 752 remains relatively still as the first leg 702 is moved relative to the second leg 704.

Although the latch 700 shown in FIGS. 21 and 22 is stamped and formed from metal stock, the latch may be made formed from drawn wire or other similar material.

Changes in construction will occur to those skilled in the art various modification embodiments may be made without departing from the scope of the invention. The matter set forth in the foregoing description and the accompanying drawings is offered by way of illustration only. It is therefore intended that the foregoing description be regarded as illustrative rather than limiting.

I claim:

1. A socket for interconnecting an electronic module to a circuit board, the socket comprising:

an insulative housing, having a module receiving recess which extends from proximate one end of the housing to proximate the opposite end of the housing;

a plurality of terminals positioned within the insulative housing, the terminals being configured to establish electrical contact with the module upon rotation of the module from a first position to a second position, the terminals applying a moment to the module when the module is in the second position;

a separate resilient latching means, located proximate one end of the housing, for holding the module in the second position and resisting the moment applied to the module by the terminals;

the resilient latching means has an integral wedge portion and an integral securing tab, the wedge portion deflects as the electronic module is rotated between the first position and the second position, the securing tab extends in a direction which is essentially perpendicular to the longitudinal axis of the module receiving recess and is positioned in an opening in the electronic module when the electronic module is provided in the second position to prevent the electronic module from being improperly removed from the socket when the electronic module is in the second position.

2. A socket as recited in claim 1 wherein the securing tab has a tapered free end, the tapered free end cooperates with a wall of the opening of the electronic module to ensure that the electronic module is properly inserted into the socket as the electronic module is rotated from the first position to the second position.

3. A socket as recited in claim 1 wherein a free end of the securing tab has a lead-in portion, a board mounting portion, and a pivoting portion, the board mounting portion has an arcuate configuration, whereby as the electronic module is rotated from the first position to the second position, the pivoting portion engages an angled surface of the projection which extends from the insulative housing causing the securing tab to pivot relative to the wedge portion, insuring that the lead-in portion and the board mounting portion will be positioned in the center of the opening when the electronic module is rotated from the first position to the second position.

4. A socket as recited in claim 1 wherein the resilient latching means is a latch which has an inner leg and an outer leg, the integral wedge portion is provided on the inner leg and the securing tab is integral with the outer leg.

5. A socket as recited in claim 1 wherein the resilient latching means is a latch which has the wedge portion provided on a first section, a second section extends from the first section and is essentially perpendicular to the first section, the second section is provided proximate a projection which extends from the insulative housing.

6. A socket as recited in claim 5 wherein the securing tab extends at an obtuse angle from the second section.

7. A socket as recited in claim 5 wherein the securing tab extends from the second section, the securing tab is essentially perpendicular to the second section and is provided proximate the projection which extends from the insulative housing, the securing tab is positioned transverse to a slot which is provided in the insulative housing to cooperate with the electronic module.

8. A socket as recited in claim 7 wherein the securing tab is spaced from the first section by a distance which is greater than the width of the projection to allow the securing tab to move relative to the projection as the electronic module is rotated between the first and the second positions.

9. A socket as recited in claim 8 wherein the latch is resiliently deformed as the electronic module is rotated between the first and the second positions, the securing tab is spaced from the first section such that the securing tab will engage the projection of the insulative housing when the latch is resiliently deformed to prevent the latch from taking a permanent set.

10. A socket as recited in claim 5 wherein the securing tab has a first movable section and a second securing section which is attached to the first movable section by a bight.

11. A socket as recited in claim 10 wherein the projection of the housing has a wide base portion and a narrow upper portion, the first movable section positioned proximate the narrow upper portion, and the second securing section positioned adjacent to and in engagement with the wide base portion, whereby as the wedge portion is deflected, the first movable section will move accordingly, and the second securing section will remain in engagement with the wide base portion.

12. An electrical connector for connecting a first substrate to a second substrate, the second substrate being rotatable relative to the first substrate between a first and an second position, the electrical connector having a housing with a recess provided therein, the recess extends from proximate a first end of the housing to proximate a second end of the housing, and is dimensioned to receive the second substrate therein, contact terminals are positioned adjacent to the recess, and are configured to make an electrical connection with the second substrate when the second substrate is in the second position in the recess, the electrical connector comprising:

a latch receiving portion positioned proximate to the first end of the housing and proximate the recess of the housing;

a separate resilient latch positioned to cooperate with the latch receiving portion, the latch has a mounting portion which is positioned to cooperate with the latch receiving portion, a latching portion which extends from the mounting portion toward the recess, and a securing portion which extends from the mounting portion toward the recess;

the securing portion will cooperate with an opening in the second substrate;

whereby as the second substrate is rotated from the first position to the second position, the latching portion of the latch cooperates with the second substrate to prevent the second substrate from being rotated back toward the first position, and the securing portion is positioned in the opening of the second substrate to prevent the second substrate from being withdrawn from the recess.

13. An electrical connector as recited in claim 12 wherein the latch has an inner leg and an outer leg, the latching portion is provided on the inner leg and the securing portion is integral with the outer leg.

14. An electrical connector as recited in claim 12 wherein the securing portion has a securing tab provided proximate a projection which extends from the insulative housing, the securing tab is positioned transverse to the longitudinal axis of the recess which is provided in the insulative housing.

15. An electrical connector as recited in claim 14 wherein the securing tab is spaced from the latching portion by a distance which is greater than the width of the projection to allow the securing tab to move relative to the projection as the second substrate is rotated between the first and the second positions.

16. An electrical connector as recited in claim 14 wherein the securing tab has a tapered free end, the tapered free end cooperates with a wall of an opening of the second substrate to ensure that the second substrate is properly inserted into the electrical connector as the second substrate is rotated from the first position to the second position.

17. An electrical connector as recited in claim 14 wherein a free end of the securing tab has a lead-in portion, a board mounting portion, and a pivoting portion, the board mounting portion has an arcuate configuration, whereby as the second substrate is rotated from the first position to the second position, the pivoting portion engages an angled surface of the projection which extends from the insulative housing causing the securing tab to pivot relative to the latching portion, insuring that the lead-in portion and the board mounting portion will be positioned in the center of the opening when the second substrate is rotated from the first position to the second position.

18. An electrical connector as recited in claim 14 wherein the securing tab has a first movable section and a second securing section which is attached to the first movable section by a bight.

19. A socket as recited in claim 18 wherein the projection of the housing has a wide base portion and a narrow upper portion, the first movable section positioned proximate the narrow upper portion, and the second securing section positioned adjacent to and in engagement with the wide base portion, whereby as the latching portion is deflected, the first movable section will move according, and the second securing section will remain in engagement with the wide base portion.

20. An electrical connector for connecting a first printed circuit board to a second printed circuit board, the electrical connector comprising:

a housing of dielectric material, mountable on the first printed circuit board, the housing including a base having a recess for receiving the second printed circuit board, the second printed circuit board being rotated relative to the first printed circuit board from a first position to a second position, the housing having a housing projection which extends from the housing proximate an end thereof;

a plurality of contacts positioned in the base adjacent the recess for establishing an electrical interconnection to the second printed circuit board;

a separable metal latch positioned proximate the recess, the latch having a flexible inner arm and an outer mounting arm;

the metal latch being secured in the housing by engagement of the mounting arm with the housing, the metal latch having a latch projection and a securing projection, the latch projection cooperates with the second printed circuit board to maintain the second printed circuit board in the second position;

the securing projection is positioned transverse to the longitudinal axis of the recess, and is spaced from a first section of the metal latch by a distance which is greater than the width of the housing projection to allow the securing projection to move relative to the housing projection as the second printed circuit board is rotated between the first and the second positions, the securing projection is configured to be received in an opening of the second printed circuit board when the second printed circuit board is rotated to the second position, thereby preventing the improper removal of the second printed circuit board from the housing.

21. An electrical connector as recited in claim 20 wherein the metal latch has an inner leg and an outer leg, the latch projection is provided on the inner leg and the securing projection is provided on the outer leg.

22. An electrical connector as recited in claim 20 wherein the securing projection has a first movable section and a second securing section which is attached to the first movable section by a bight section.

23. An electrical connector as recited in claim 22 wherein a housing projection of the housing has a side base portion and a narrow upper portion, the first movable section positioned proximate the narrow upper portion, and the second securing section positioned adjacent to and in engagement with the wide base portion, whereby as the latch projection is deflected, the first movable section will move accordingly, and the second securing section will remain in engagement with the wide base portion.

24. A circuit board latching device for a connector comprising:

a mounting section which cooperates with an insulating housing of the connector to maintain the circuit board latching device in position relative to the connector;

a resilient circuit board latching section to latch a circuit board in position relative to the connector;

a releasing section, integral with the resilient circuit board latching section, for externally releasing the latching of the circuit board by the resilient circuit board latching section;

a securing section, to secure the circuit board in the connector when the circuit board is latched by the resilient circuit board latching section, the securing section has a first movable portion and a second securing portion which is attached to the first movable portion by a bight portion;

whereby the mounting, latching, releasing, and securing sections are integrally made of a metal plate member.

25. A circuit board latching device as recited in claim 24 wherein the securing section is integral with an extends from the resilient circuit board latching section.

26. A circuit board latching device as recited in claim 25 wherein the securing section is provided proximate a housing projection which extends from the housing, the securing section is positioned transverse to a recess of the housing, the securing section is spaced from a first portion of the metal latch by a distance which is greater than the width of the housing projection to allow the securing section to move relative to the housing projection as the second printed circuit board is rotated between the first and the second positions.

27. A circuit board latching device as recited in claim 24 wherein a housing projection of the housing has a side base portion and a narrow upper portion, the first movable portion positioned proximate the narrow upper portion, and the second securing portion positioned adjacent to and in engagement with the wide base portion, whereby as the latching section is deflected, the first movable portion will move accordingly, and the second securing portion will remain in engagement with the wide base portion.

28. An electrical connector as recited in claim 24 wherein the circuit board latching device has an inner leg and an outer leg, the latching section is provided on the inner leg and the securing section is provided on the outer leg.

* * * * *